United States Patent [19]

Romankiw

[11] 3,981,844

[45] Sept. 21, 1976

[54] STABLE EMULSION AND METHOD FOR PREPARATION THEREOF

[75] Inventor: Lubomyr T. Romankiw, Briarcliff Manor, N.Y.

[73] Assignee: IBM, Armonk, N.Y.

[22] Filed: June 30, 1975

[21] Appl. No.: 591,981

[52] U.S. Cl. ..... 252/62.52; 252/62.51

[51] Int. Cl.[2] ..... H01F 1/00

[58] Field of Search ..... 252/62.52, 62.51

[56] References Cited

UNITED STATES PATENTS

| | | | |
|---|---|---|---|
| 2,900,343 | 8/1959 | Burns et al. | 252/62.52 |
| 3,796,660 | 3/1974 | Kaiser | 252/62.51 X |
| 3,843,540 | 10/1974 | Reimers et al. | 252/62.51 X |

OTHER PUBLICATIONS

Addendum to Technical Report 1213 pub. 5–9–1949 4 pages.

*Primary Examiner*—F.C. Edmundson

*Attorney, Agent, or Firm*—Pollock, Vande Sande & Priddy

[57] ABSTRACT

An emulsion of water; a water immiscible liquid including a solution of a liquid nonpolar hydrocarbon and a liquid halogenated aliphatic hydrocarbon; and a colloidal suspension of magnetic particles and a surface active agent.

18 Claims, No Drawings

STABLE EMULSION AND METHOD FOR PREPARATION THEREOF

BACKGROUND OF THE INVENTION

Colloidal suspensions of magnetic particles which have been referred to as ferromagnetic fluids or ferrofluids are well known and have been proposed for application in such diverse areas as rotary seals, liquid brushes, liquid bearings, artificial muscles, fluidic valves, contact point lubricators, magnetic inks, cleanup fluids for oil slicks on water, and when suspended in a host fluid for use in applications such as magnetic toys and magnetic displays.

It is known that various conventional colloidal suspensions of magnetic particles such as magnetite ($Fe_3O_4$) stabilized by a surface active agent when brought into contact with a host liquid tend to degrade over a relatively short period of time whereby their magnetic properties are lost. In particular, such degradation occurs wherein the colloidal suspension changes into a solution in the host liquid or forms a highly viscous shapeless often nonmagnetic lump which can no longer be broken up into droplets of colloidal size and if broken up can not be recollected into one ferromagnetic fluid poll by a magnetic field. It is believed that the degradation occurs through leaching out of the surface active agent from the aqueous phase into the host fluid and/or by hydration of $Fe_3O_4$.

For a further discussion of colloidal suspensions of magnetic particles or ferrofluids, the following exemplary literature articles are of interest:

1. "Magnetic Fluid, An Introduction to the Phenomena and Applications of Magnetic Fluid Technology", Manual 273, Ferrofluidics Corporation, April 1973,
2. R. Keiser and Gabor Miskolczy, "Some Applications of Ferrofluid Magnetic Colloids", IEEE on Magnetics Mag. 6, No. 3, September 1970,
3. R. Keiser and G. Miskolczy, "Magnetic Properties of Stable Dispersions of Subdomain Magnetic Particles", J. Appl. Phys. Vol. 41, No. 3, 1064–1072, 1 March 1970.

Heretofore, various known colloidal suspensions of magnetite stabilized by surface active agents such as sodium oleate in water when contacted with a host organic liquid degraded within a few weeks resulting in the decomposition of the colloidal suspension in water, such as by escape of the magnetite from the aqueous phase to the organic phase, by swelling of the ferrofluid phase, or by hardening of the ferrofluid phase. This, in turn, resulted in loss of the magnetic properties of the aqueous phase and/or of the fluidity of the aqueous magnetic phase. Moreover, even when sufficiently stable, such suspensions suffer from the disadvantage of requiring relatively large magnetic forces to be moved through the host liquid.

Accordingly, it is an object of the present invention to provide a ferromagnetic fluid dispersed in a host solution wherein the dispersion or emulsion has a long shelf life (i.e., is stable for a long period of time against deterioration while sitting undisturbed or while being agitated mechanically or magnetically).

In addition, it is an object of the present invention to provide a ferromagnetic fluid emulsified in a host liquid which forms relatively small droplet size. In addition, the objects of the present invention include providing ferromagnetic fluid droplets which have small inertia, are equidense with the host fluid and require very little force to be moved through the host solution.

BRIEF DESCRIPTION OF THE INVENTION

The present invention is concerned with an emulsion containing a continuous and a discontinuous phase and comprisng:

A. water;

B. a water-immiscible liquid phase comprising a solution of:
   1. a liquid nonpolar hydrocarbon being aliphatic hydrocarbon and/or aromatic hydrocarbon; and
   2. a liquid halogenated aliphatic hydrocarbon;

C. a colloidal suspension in the discontinuous or continuous phase of the emulsion of ferromagnetic particles and a surface active agent in an amount at least sufficient for stabilizating the ferromagnetic particles in the desired discontinuous or continuous phase of the emulsion;

D. the relative proportions of the nonpolar hydrocarbon and the halogenated aliphatic hydrocarbon being such that the density of the continuous phase and the density of the discontinuous phase are substantially equal to each other; and E. the nonpolar hydrocarbon and halogenated aliphatic hydrocarbon being mutually soluble in each other and being compatible with the surface-active agent.

DESCRIPTION OF PREFERRED EMBODIMENTS

Colloidal suspensions of ferromagnetic particles and emulsifying agents in a liquid are well known and are sometimes referred to as ferromagnetic fluids or ferrofluids. The magnetic particles employed heretofore, as well as in the present invention, are usually magnetite ($Fe_3O_4$); $\gamma$-$Fe_2O_3$ and manganese-zinc ferrite with the preferred magnetic particles being magnetite.

When the colloidal suspension is an aqueous suspension, the density is generally from about 1.05 to about 1.9 g/cc and preferably from about 1.1 to about 1.6 g/cc. When the colloidal suspension is a suspension in a water-immiscible organic liquid, the density is generally between about 0.9 and about 1.1 g/cc, and preferably about 1 g/cc.

The colloidal suspensions employed according to the present invention usually contain from about 5% to about 40% by volume of ferromagnetic particles in the colloidal suspension. The particle size of the ferromagnetic particles is generally from about 25 to about 300 A. and preferably from about 75 to about 200 A.

The surface active agent generally includes an anionic and/or cationic surface active agent or dispersing agent. Illustrative of some anionic dispersing agents suitable for the present invention include long chain ethylenically unsaturated aliphatic fatty acids containing from about 8 to about 28 carbon atoms such as oleic acid, linoleic acid, linolenic acid, myristolenic acid, and palmitoleic acid, or salts such as alkali metal or ammonium salts thereof. Illustrative of cationic surface active agents include quaternary compounds and amines such as the quaternary ammonium salts, alkyl amines quaternary sulfonium compounds, quaternary phosphonium compounds ad ethoxylated quaternary ammonium compounds.

Examples of quaternary ammonium salts are compounds of the formula:

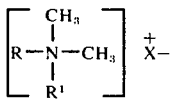

wherein R and $R^1$ are the same or different and are about 8 to 24 carbon atom branched or straight chain alkyl or benzyl radicals and preferably R and $R^1$ are $C_{12}$ to $C_{18}$ groups. A minor amount of unsaturation may be present in R and $R^1$. x is a suitable anion such as a halogen ion.

As examples of sulfonium compounds are compounds of the formula:

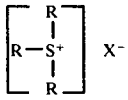

As examples of phosphonium cationics are compounds of the formula:

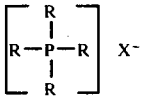

In the above sulfonium and phosphonium compounds, the R groups are the same or different $C_1$ to $C_{24}$ alkyl groups, with preferably two of the R groups being methyl and the others being at least $C_8$.

The amount and type of ionic dispersing agent is generally selected to provide an interfacial tension between the magnetic fluid and air of about 20 to about 40 dynes/cm and preferably from about 24 to about 36 dynes/cm. Usually from about 2 to about 15% by weight based on the ferromagnetic particles of the ionic dispersing agent will be sufficient and preferably from about 5 to about 10% by weight.

Ferromagnetic fluids containing magnetic particles of size and amount contemplated for use in the present invention are available from a number of commercial sources such as Avco Corporation, Evert, Massachusetts and Ferrofluidics Corporation, Burlington, Mass. or may be prepared in a manner known in the art. For example, the following general procedure may be employed for preparing suspensions of magnetite.

Ferric chloride and ferrous chloride are dissolved in separate bodies of water to form solutions thereof. The solutions are mixed in amounts to maintain the molar ratio $Fe^{+3}/F^{+2}$ slightly under the theoretical value of 2.0 without deaerating the solutions. Oxygen in the solution will oxidize some ferrous ions to ferric ions. Magnetite can be formed by chemical precipitation of the ferrous-ferric mixture with a base such as ammonium hydroxide.

In order to favor a high rate of magnetite nucleation coupled with a slow rate of particle growth, chemical precipitation can be carried out at low temperatures, for example, in an ultrasonic bath maintained at about 5–12° C. The pH of a mixture during chemical precipitation for deposition of magnetite is maintained between about 8.9 and 10.2 and preferably about 9.5, with the amount of hydroxide used being adjusted accordingly, In order to aid in the prevention of agglomeration of magnetite during and immediately subsequent to the chemical precipitation, a dispersing agent is usually added to the precipitation mixture, during or shortly after the addition of the hydroxide (i.e., within a few seconds of such addition). Ancillary to agglomeration prevention, the dispersing agents will also aid in the maintenance of the desired small particle size of the magnetite. The dispersing aid is selected from those materials known to prevent interparticle attraction between individual magnetite particles. Such materials as mentioned above are usually ethylenically unsaturated aliphatic monocarboxylic acids containing from about 8 to about 28 carbon atoms or salts thereof.

Next the carboxylic acid coated magnetite particles in the aqueous suspension are heated to about 60 to about 100° C to increase the magnetic moment thereof and the pH of the mixture is decreased from about 8 to about 6 to aid in the formation of the magnetite particles. Next the particles are rinsed with distilled water to remove any formed $NH_4Cl$ salt and separation can be carried out in any conventional manner such as by use of an ultracentrifuge. After this, the magnetite particles can be redispersed in water to provide the colloidal suspension useful in practicing the present invention.

The water-immiscible organic liquid employed in the present invention contains a liquid nonpolar hydrocarbon and a liquid halogenated aliphatic hydrocarbon. The liquid nonpolar hydrocarbon can be an aliphatic hydrocarbon and/or an aromatic hydrocarbon.

The number of carbon atoms of any one particular hydrocarbon is merely limited by the necessity for the nonpolar hydrocarbon to be a liquid and to be mutually soluble with the halogenated aliphatic hydrocarbon in the amounts employed. Accordingly, if a mixture of nonpolar hydrocarbons is employed, any one hydrocarbon of the mixture can be solid provided the mixture of the nonpolar hydrocarbons is liquid.

The aliphatic hydrocarbon can be saturated or ethylenically unsaturated, and generally contains from about 5 carbon atoms to about 17 carbon atoms and preferably from about 6 to about 15 carbon atoms. Some examples of aliphatic hydrocarbons suitable for the present invention include pentane, hexane, 2-methylpentane, 3-methylpetane, 2,3-dimethylbutane, 2,2-dimethylbutane, 2,4-dimethyl-5-butylnonane, octane, nonane, decane, undecane, dodecane, tridecane, kerosene, tetradecane and mineral oil. The term "aromatic hydrocarbons" as used herein includes unsubstituted and alkyl substituted aromatic compounds exemplary of which are benzene and naphthalene. The alkyl groups which can be present as substituents on the aromatic compound contain from about 1 to 22 carbon atoms.

The preferred nonpolar hydrocarbons employed according to the present invention are kerosene, decahydronaphthalene, heptane, decane, and benzene.

The liquid halogenated aliphatic hydrocarbon includes both halogenated unsaturated and halogenated saturated aliphatic hydrocarbons. Preferably, the halogenated hydrocarbons contain at least one fluorene atom. The halogenated hydrocarbons generally contain from 1 to about 10 carbon atoms and preferably from about 1 to 3 carbon atoms as long as they are mutually soluble with the nonpolar hydrocarbon in the amounts employed. Exemplary of suitable liquid halogenated aliphatic hydrocarbons are trichloroethylene, and the freons such as dichlorofluoromethane, dichlorodifluoromethane, and trichlorofluoromethane. The preferred halogenated hydrocarbons are trichlorofluoromethane and trichloroethylene.

The nonpolar hydrocarbon and the halogenated hydrocarbon must be mutually soluble in each other in the amounts employed and must be compatible with the surface-active agent present in the colloidal suspension of the ferromagnetic particles. Preferably, the nonpolar hydrocarbon and halogenated hydrocarbon are not readily reducible in the presence of mild oxidizing agents such as $Fe^{++}$, and are not carriers of oxygen.

In addition, the nonpolar hydrocarbon and halogenated hydrocarbon are mixed in relative proportions so that the density of the water-immiscible organic liquid phase is substantially equal to the density of the aqueous phase of the emulsion (i.e., the density of the aqueous phase plus or minus about 10%). The organic is preferably presaturated with the surface-active agent used to suspend the ferromagnetic particles and to stabilize the colloidal suspension, and usually with amounts less than about 0.1% by weight. Generally, the nonpolar hydrocarbon is present in the solution in an amount from about 30 to about 70% and preferably from about 40 to about 60% based upon the total weight of the nonpolar hydrocarbon and halogenated hydrocarbon. The halogenated hydrocarbon is generally present in the host liquid in an amount from about 30% to about 70% by weight and preferably from about 60% to about 40% by weight based upon the total weight of the nonpolar hydrocarbon and halogenated hydrocarbon.

The relative proportions of the aqueous phase and the organic liquid phase can vary over a wide range and are not particularly critical to the practice of the present invention. The relative amounts can be such as to provide either water-in-oil emulsion or an oil-in-water emulsion. When a water-in-oil emulsion is desired in an application such as a display wherein the aqueous phase is the magnetic phase, generally the relative proportions of the aqueous phase and organic liquid phase are from about 5% to about 40% by weight of the aqueous phase and correspondingly about 95% to about 60% by weight of the organic liquid phase.

When an oil-in-water emulsion is desired, generally the relative proportions of the aqueous phase and organic liquid phase are from about 95% to about 60% by weight of the aqueous phase and from about 5% to about 40% by weight of the organic liquid phase. Preferably the emulsions of the present invention are water-in-oil emulsions. When water-in-oil emulsions are employed, the ferromagnetic particles can be suspended in the aqueous phase or organic liquid phase, and preferably the aqueous phase (the discontinuous phase). When oil-in-water emulsions are employed, the ferromagnetic particles can be suspended either in the aqueous or in the organic liquid phase, and preferably in the discontinuous organic liquid phase.

By following the present invention, emulsions of the colloidal suspension are obtained which are extremely stable over relatively long periods of time as will be shown herein below.

In addition, in a preferred aspect of the present invention, droplets of the ferromagnetic particles in the liquid of the discontinuous phase formed under mild agitation are relatively small and generally from about 100 microns to about 800 microns and preferably from about 200 to bout 600 microns so that gravity plays a very limited role. Accordingly, the colloidal suspension of the ferromagnetic particles in the emulsion are highly sensitive to small magnetic fields or to small magnetic field differentials and can be easily moved about therein with only a few oersteds/cm of the field gradient.

The composition of the present invention can be employed in various toys and displays which have been suggested in the prior art which utilize ferromagnetic fluids. It is preferred that the storage vessel for the compositions be made of glass, $SiO_2$, quartz, or of inorganic or organic material which does not dissolve or any of its constituents do not preferentially leach out, dissolve or otherwise react with the constituents of the compositions. Moreover, it is preferably that the compositions be stored in the absence or air, oxygen, or other gases which could react with the host liquid or other constituents of the composition.

Another particular advantage of the preferred aspects of the present invention is that the continuous phase of the emulsion wets the container walls thereby preventing the colloidal suspension from adhering thereto. This results in minimal friction between the droplets in the discontinuous phase and the walls of the container or the magnetic propagating pattern, and in complete transparency of the walls.

It is theorized that the stability of the compositions of the present invention is probably related to the interfacial tension between the colloidal suspension, the discontinuous phase and the continuous phase and possibly is related to the reduced or limited tendency of the surface-active agent in the colloidal suspension to leave the surface of the ferromagnetic particles and to dissolve in the other phase.

According to the present invention, the density of the continuous phase is about equal to the density of the discontinuous phase. Moreover, with respect to the emulsions, it is speculated that the successful stability of the present invention is due at least in part to some type of surface-type interaction between the type of organic liquid employed and the surfactant on the colloidal ferromagnetic particles which maintains the stability of the composition and protects against the surface-active agent being leached from one phase to the other phase of the emulsion.

The following nonlimiting examples are provided wherein all parts are by weight unless the contrary is stated.

EXAMPLE 1

Part A

About 10 parts of a ferromagnetic colloidal suspension of magnetite in water and having a density of about 1.2 grams per cc and having a 200 Gauss magnetic moment and containing oleic acid surfactant is emulsified into about 90 parts of a water-immiscible host liquid of 40 parts of kerosene per 60 parts of dichlorodifluoromethane. The mixture is stored in glass container capped with an aluminum cap, and despite frequent mechanical and magnetic agitation is stable for at least 3 years.

Part B

Part A of this example is repeated except that the host liquid is about 95 parts of kerosene. Although the emulsion is stable for at least about one year and probably for at least two years, it does not react nearly as readily to very small magnetic field gradients as does the composition of Part A of this example.

Part C

Part A is repeated except that the host liquid is about 95 parts of dichlorodifluoromethane. The emulsion is only stable for about 3 to 4 months.

As apparent from a comparison of Part A of this example with Parts B and C, the present invention unexpectedly provides relatively long emulsion stability, and at the same time gravity insensitive emulsion in which the magnetic droplets are easily moved by providing only a small magnetic field gradient.

EXAMPLE 2

Example 1 is repeated except that a number of emulsions are prepared wherein the host liquid is 100 parts of a mixture of about 60 to 95 parts of decahydronaphthalene and correspondingly about 40 to 5 parts of dichlorofluoromethane. The emulsions are stable for at least two years.

EXAMPLE 3

Example 1 is repeated except that a number of emulsions are prepared wherein the host liquid is 100 parts of a mixture of 30 to 70 parts of kerosene and correspondingly 70 to 30 parts of trichloroethylene. The emulsions are stable for at least two years.

EXAMPLE 4

Example 1 is repeated except that about 40 parts of the ferromagnetic suspension in water are emulsified into about 60 parts of the water-immiscible host liquid. The mixture is stable for at least about two years.

EXAMPLE 5

Example 1 is repeated except that about 10 parts of the water-immiscible liquid are emulsified into about 90 parts of the ferromagnetic colloidal suspension. The mixture is stable for at least about two years.

The emulsions of Examples 1A and 2–5 are gravity insensitive wherein the magnetic droplets are easily moved by providing only a small magnetic field gradient.

What is claimed is:

1. An emulsion having a continuous and discontinuous phase comprising:
   A. water;
   B. a water-immiscible organic liquid phase comprising a solution of:
      1. a liquid nonpolar hydrocarbon selected from the group consisting of aliphatic hydrocarbons, aromatic hydrocarbons, and mixtures thereof; and
      2. a liquid halogenated aliphatic hydrocarbon;
   C. a colloidal suspension in the discontinuous or continuous phase of the emulsion of ferromagnetic particles and a surface-active agent in an amount at least sufficient to stabilize the ferromagnetic particles in the desired discontinuous or continuous phase of the emulsion;
   D. the relative proportions of said nonpolar hydrocarbon and said halogenated aliphatic hydrocarbon being such that the density of the water phase and the density of the water-immiscible liquid phase are substantially equal to each other; and
   E. said nonpolar hydrocarbon and said halogenated aliphatic hydrocarbon being mutually soluble in each other and being compatible with said surface-active agent.

2. The emulsion of claim 1 which is a water-in-oil emulsion and said magnetic particles are suspended in the water.

3. The emulsion of claim 1 wherein said magnetic particles are magnetite.

4. The emulsion of claim 1 wherein said colloidal suspension is an aqueous colloidal suspension having a density between about 1.05 grams per cc to about 1.9 grams per cc.

5. The emulsion of claim 1 wherein said surface-active agent is an ionic surface-active agent.

6. The emulsion of claim 1 wherein said surface-active agent is an aliphatic carboxylic acid having about 8 to 28 carbon atoms or salt thereof.

7. The emulsion of claim 1 wherein said surface-active agent is oleic acid or salt thereof.

8. The emulsion of claim 1 wherein said liquid nonpolar hydrocarbon is selected from the group consisting of kerosene, decahydronaphthalene, heptane, decane, and benzene.

9. The emulsion of claim 1 wherein said liquid halogenated hydrocarbon is trichloroethylene.

10. The emulsion of claim 1 wherein said liquid halogenated hydrocarbon is dichlorodifluoromethane.

11. The emulsion of claim 1 wherein said organic liquid is a mixture of kerosene and trichloroethylene.

12. The emulsion of claim 1 wherein said organic liquid is a mixture of kerosene and dichlorodifluoromethane.

13. The emulsion of claim 1 wherein said organic liquid is a mixture of decahydronaphthalene and dichlorodifluoromethane.

14. The emulsion of claim 1 wherein said surface-active agent is oleic acid or salt thereof and said organic liquid is a mixture of kerosene and trichloroethylene.

15. The emulsion of claim 1 wherein said surface-active agent is oleic acid or salt thereof and said water-immiscible organic liquid is a mixture of kerosene and dichlorodifluoromethane.

16. The emulsion of claim 1 wherein said surface-active agent is oleic acid or salt thereof and said organic liquid is a mixture of decahydronaphthalene and dichlorodifluoromethane.

17. The emulsion of claim 1 wherein the organic liquid phase is presaturated with said surface-active agent.

18. A method of preparing an article containing a water and water-immiscible organic liquid emulsion of increased stability having a continuous liquid phase and a discontinuous liquid phase which comprises:
   A. providing water;
   B. providing a water-immiscible organic solution of a liquid nonpolar hydrocarbon selected from the group consisting of aliphatic hydrocarbons, aromatic hydrocarbons, and mixtures thereof, and a liquid halogenated aliphatic hydrocarbon, said polar hydrocarbon and said halogenated aliphatic hydrocarbon being mutually soluble in each other;
   C. providing a colloidal suspension of ferromagnetic particles and surface-active agent in the liquid which is to be the discontinuous phase or the continuous phase of the emulsion;
   D. the water-immiscible organic soluton being compatible with the surface-active agent of said colloidal suspension;

E. the relative proportions of said polar hydrocarbon and said halogenated aliphatic hydrocarbon being such that the density of the water phase and the density of the water-immiscible liquid phase are substantially equal to each other;

F. admixing the colloidal suspension of ferromagnetic particles and the liquid which is to be the other of the discontinuous or continuous phase not containing the colloidal suspension to thereby provide an emulsion; then G. adding said emulsion to a container of a material which does not dissolve or react with the constituents of the emulsion; and H. storing in the absence of gases which could react with the constituents of the emulsion.

* * * * *

UNITED STATES PATENT AND TRADEMARK OFFICE

CERTIFICATE OF CORRECTION

PATENT NO. : 3,981,844

DATED : September 21, 1976

INVENTOR(S) : Lubomyr T. Romankiw

It is certified that error appears in the above-identified patent and that said Letters Patent are hereby corrected as shown below:

In the Heading, please correct the name of the assignee to:
-- International Business Machines Corporation,
Armonk, New York --

Column 1, line 24, change "poll" to -- pool --.

Column 1, line 40, after "Phys." insert a comma.

Column 1, line 51, after "and/or" insert -- loss --.

Column 2, line 16, change "stabilizating" to -- stabilizing --.

Column 2, line 60, after "amines" insert a comma.

Column 2, line 61, change "ad" to -- and --.

Column 3, the 5th line after the first formula, change "x" to -- X --.

Column 3, the 24th line from the bottom, after "containing" insert -- dispersed --.

Column 4, line 47, change "3-methylpetane" to -- 3-methylpentane --.

Column 5, line 19, after "organic" insert -- phase --.

Column 6, line 1, change "bout" to -- about --.

UNITED STATES PATENT AND TRADEMARK OFFICE

CERTIFICATE OF CORRECTION

PATENT NO. : 3,981,844

DATED : September 21, 1976

INVENTOR(S) : Lubomyr T. Romankiw

It is certified that error appears in the above-identified patent and that said Letters Patent are hereby corrected as shown below:

Column 6, line 16, change "preferably" to -- preferable --.

Column 6, line 17, change "or" to -- of --.

Claim 5, line 2, change "ionic" to -- anionic --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*